US012575631B2

(12) United States Patent
Fu et al.

(10) Patent No.: US 12,575,631 B2
(45) Date of Patent: Mar. 17, 2026

(54) INNER BUFFER LAYER OF RIDING HELMET AND HELMET STRUCTURE

(71) Applicant: Dongguan City EON Sporting Goods Co., Ltd., Dongguan City (CN)

(72) Inventors: Jiabing Fu, Dongguan City (CN); Guoding Wang, Hong Kong (HK)

( * ) Notice: Subject to any disclaimer, the term of this patent is extended or adjusted under 35 U.S.C. 154(b) by 253 days.

(21) Appl. No.: 18/493,801

(22) Filed: Oct. 25, 2023

(65) Prior Publication Data

US 2024/0090611 A1 Mar. 21, 2024

(30) Foreign Application Priority Data

Jul. 31, 2023 (CN) ..... 202310945804.8

(51) Int. Cl.
*A43B 3/00* (2022.01)
*A42B 3/12* (2006.01)

(52) U.S. Cl.
CPC ..... *A42B 3/125* (2013.01)

(58) Field of Classification Search
CPC .. A42B 3/125; A42B 3/10; A42B 3/12; A42B 3/124; A42B 3/066
See application file for complete search history.

(56) References Cited

U.S. PATENT DOCUMENTS 3,186,004 A * 6/1965 Carlini ..... A42B 3/122 D29/106
3,231,454 A * 1/1966 Williams ..... B65D 81/03 297/DIG. 8
3,425,061 A * 2/1969 Webb ..... A42B 3/065 D29/102
3,447,163 A * 6/1969 Tojeiro ..... A42B 3/065 428/116
4,432,099 A * 2/1984 Grick ..... A42C 2/007 2/909
4,766,614 A * 8/1988 Cantwell ..... A42B 3/281 2/419
5,470,641 A * 11/1995 Shuert ..... B29C 51/267 428/178
6,336,220 B1 * 1/2002 Sacks ..... A43B 1/0009 428/116
6,752,450 B2 * 6/2004 Carroll, III ..... B65D 81/127 293/133

(Continued)

*Primary Examiner* — Richale L Quinn
(74) *Attorney, Agent, or Firm* — Addison D. Ault; IPGentleman Intellectual Property Services, LLC

(57) ABSTRACT

The present invention provides an inner buffer layer of a riding helmet and a helmet structure. The inner buffer layer of the riding helmet comprises an inner buffer layer; the inner buffer layer comprises a skeleton body made of foam buffer materials; buffer bodies made of foam buffer materials are embedded in hollow grooves of the skeleton body; and the surfaces of the buffer bodies are provided with buffer layers. The buffer layers are a plurality of buffer bulges fixedly connected to the surfaces of the buffer bodies. The installed skeleton body ensures the structural strength of the inner buffer layer. Moreover, the plurality of buffer bulges installed can make the helmet match with a fabric inner cushion body in the wearing process, which can effectively increase the frictional force and effectively prevent the helmet from falling off the head of a wearer at the moment of accident impact.

4 Claims, 7 Drawing Sheets

(56) References Cited

U.S. PATENT DOCUMENTS

| | | | | |
|---|---|---|---|---|
| 8,533,869 | B1 * | 9/2013 | Capuano | A42B 3/12 2/411 |
| 10,219,574 | B2 * | 3/2019 | Lee | A42B 3/122 |
| 10,219,575 | B2 * | 3/2019 | Stringfellow | A42B 3/124 |
| 10,736,373 | B2 * | 8/2020 | Chilson | A42B 3/127 |
| 10,798,985 | B2 * | 10/2020 | Manera | A42B 3/125 |
| 11,641,904 | B1 * | 5/2023 | Leon | A42B 3/064 2/411 |
| 2002/0017805 | A1 * | 2/2002 | Carroll, III | B32B 27/304 188/371 |
| 2002/0056521 | A1 * | 5/2002 | Chen | A42B 3/00 156/410 |
| 2012/0317705 | A1 * | 12/2012 | Lindsay | A42B 3/062 2/413 |
| 2013/0232674 | A1 * | 9/2013 | Behrend | A41D 13/0543 2/455 |
| 2013/0283511 | A1 * | 10/2013 | Diamond | A41D 13/0153 2/455 |
| 2015/0047110 | A1 * | 2/2015 | Chilson | A42B 3/281 29/283.5 |
| 2015/0047113 | A1 * | 2/2015 | Stringfellow | A42B 3/124 428/116 |
| 2016/0255898 | A1 * | 9/2016 | Cormier | B60R 21/04 |
| 2016/0345651 | A1 * | 12/2016 | Dvorak | A42B 3/124 |
| 2017/0347741 | A1 * | 12/2017 | Manera | A42B 3/063 |
| 2018/0184745 | A1 * | 7/2018 | Stone | A42B 3/065 |
| 2019/0307199 | A1 * | 10/2019 | Hall | A42B 3/127 |
| 2020/0008510 | A1 * | 1/2020 | Garneau | A42B 3/12 |
| 2023/0000195 | A1 * | 1/2023 | Cheng | B32B 3/266 |
| 2023/0413937 | A1 * | 12/2023 | Cook | A42B 3/124 |
| 2025/0000194 | A1 * | 1/2025 | Yu | F16F 1/374 |
| 2025/0221487 | A1 * | 7/2025 | Jensen | A42B 3/32 |

* cited by examiner

INNER BUFFER LAYER OF RIDING HELMET AND HELMET STRUCTURE

TECHNICAL FIELD

The present invention belongs to the technical field of riding helmets, and particularly relates to an inner buffer layer of a riding helmet and a helmet structure.

BACKGROUND

The existing helmet is generally composed of a helmet body, an inner buffer layer and a wearing device, wherein the helmet body is generally made of hard materials. The inner buffer layer is arranged on the inner surface of the helmet body for absorbing the impact force generated, and the wearing device is used for fixing the helmet body to the head of a human body. However, the existing inner buffer layer of the helmet is generally one inner buffer layer for one helmet, which has poor replaceability and universality. Moreover, the existing inner buffer layer of integrated structure acts directly on the head for buffer when a person is impacted, and the buffer effect is not good. Based on this, an inner buffer layer is provided, which can be flexibly replaced, and when acting on the human head for buffer, an inner buffer layer of a riding helmet and a helmet structure with large buffer and good buffer effect have good market prospects.

SUMMARY

The purpose of the present invention is to provide an inner buffer layer of a riding helmet and a helmet structure to solve problems proposed in the background.

To achieve the above purpose, the present invention provides the following technical solution: the inner buffer layer of the riding helmet comprises an inner buffer layer; the inner buffer layer comprises a skeleton body made of foam buffer materials; buffer bodies made of foam buffer materials are embedded in hollow grooves of the skeleton body; and the surfaces of the buffer bodies are provided with buffer layers;

The buffer layers are a plurality of buffer bulges fixedly connected to the surfaces of the buffer bodies.

As a preferred solution of the present invention, the inner buffer layer and the buffer bodies are made of EPS foamed plastic, polyethylene foamed plastic or polyurethane foam material.

As a preferred solution of the present invention, the hollow groove of the skeleton body is one or more of a honeycomb groove, a round groove or a polygonal groove.

As a preferred solution of the present invention, the buffer body is one or more of a hexagonal buffer body, a cylindrical buffer body or a polygonal buffer body.

As a preferred solution of the present invention, the buffer bulge is one or more of a cylindrical bulge, a triangular bulge or a polygonal bulge.

As a preferred solution of the present invention, the plurality of buffer bulges are arranged at equal distance or non-equal distance on the surfaces of the buffer bodies, and one end of the plurality of buffer bulges is equidistant from the head of a wearer.

A helmet structure comprises the inner buffer layer of the riding helmet, and further comprises a helmet body; a skeleton body is bonded in the helmet body; a plurality of buffer bodies are arranged in hollow grooves of the skeleton body; a fabric inner cushion body is also arranged at the inner side of each buffer body; and the edge of the fabric inner cushion body is pressed and fixed by a pressing ring arranged on the edge of the helmet body.

As a preferred solution of the present invention, both sides of the bottom of the helmet body are fixedly connected with helmet belts, and one end of the two helmet belts is fixedly connected through a belt buckle.

As a preferred solution of the present invention, the bottom of the pressing ring is fixedly connected with a plurality of wedge pins, and the pressing ring is fitted with the bottom of the helmet body and then clamped and connected with a clamping groove arranged at the bottom of the helmet body.

As a preferred solution of the present invention, the size of the inner buffer layer is adapted with the size of the helmet body, and the size of the fabric inner cushion body is adapted with the size of the inner buffer layer.

Compared with the prior art, the present invention has the following beneficial effects:

1) The installed skeleton body ensures the structural strength of the inner buffer layer, and the installed hollow grooves are convenient for users to disassemble and assemble the buffer bodies, so that the buffer bodies of the inner buffer layer can be flexibly replaced according to the use demand of patients, and the universality of the inner buffer layer can be increased. The buffer layers formed by the plurality of buffer bulges are arranged on the surfaces of the buffer bodies. While ensuring that the buffer bodies have good buffering, the buffer bulges can increase the buffering performance and buffer stroke, and further increase the buffer effect of the inner buffer layer. Moreover, the plurality of buffer bulges installed can make the helmet match with the fabric inner cushion body in the wearing process, which can effectively increase the frictional force, effectively prevent the helmet from falling off the head of the wearer at the moment of accident impact, and increase the protective safety of the helmet adapted with the inner buffer layer.
2) A plurality of buffer bodies can be processed into honeycombs, cylinders or polygons, and the plurality of buffer bulges can be processed into cylindrical bulges, triangular bulges or polygonal bulges according to processing needs. Moreover, the plurality of buffer bulges can be flexibly distributed on the surfaces of the buffer bodies according to the buffer needs, and the buffer bulges can also be processed into bulges with different lengths according to the buffer and wearing needs, to effectively improve the adaptability of the inner buffer layer, realize the customization of the helmet adapted with the inner buffer layer and increase the market competitiveness of the helmet.

DESCRIPTION OF DRAWINGS

The drawings are used to provide further understanding for the present invention and constitute part of the description. The drawings are used to explain the present invention together with the embodiments of the present invention, and do not constitute a limitation to the present invention. In the drawings.

Figure 1:
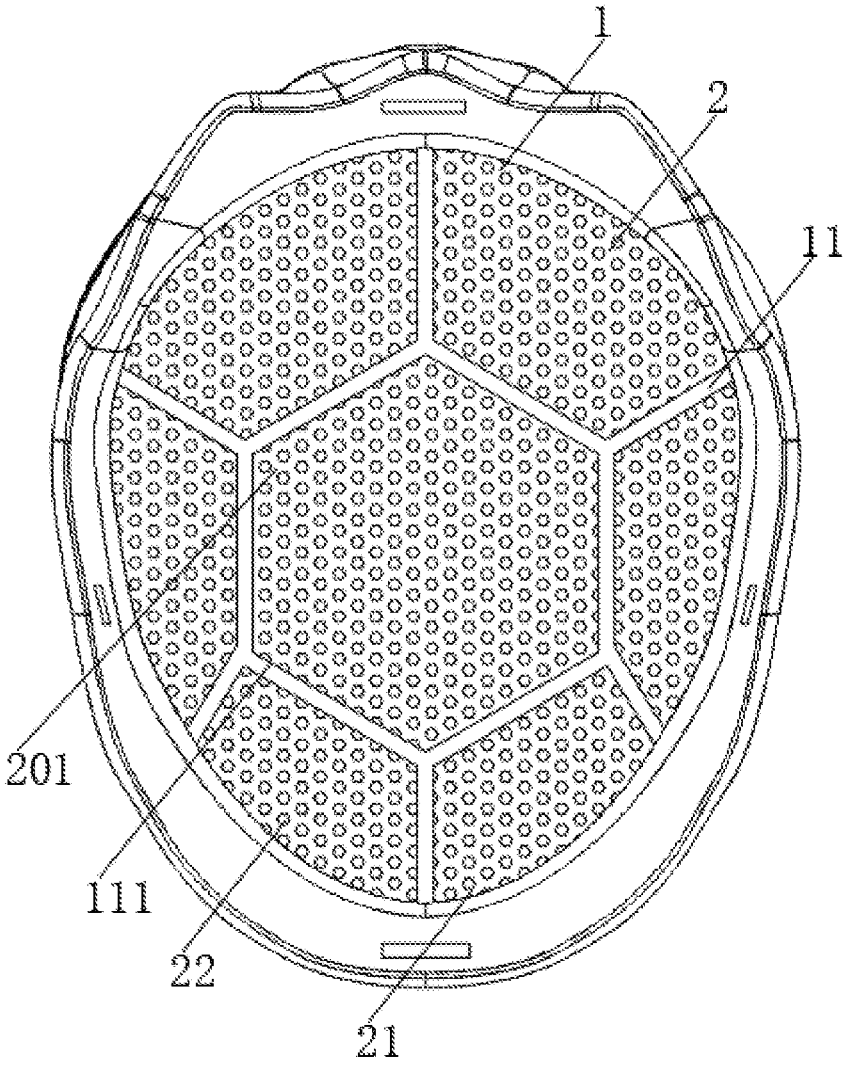
FIG. 1 is a structural schematic diagram of the present invention.

In the drawings: 1 inner buffer layer; 11 skeleton body; 111 honeycomb groove; 2 buffer body; 201 hexagonal buffer body; 202 cylindrical buffer body; 203 polygonal buffer body; 21 buffer layer; 22 buffer bulge; 221 cylindrical bulge; 222 polygonal bulge; 3 helmet body; 31 pressing ring; 311 wedge pin; 32 helmet belt; 33 belt buckle; 34 clamping groove; 4 fabric inner cushion body.

DETAILED DESCRIPTION

The technical solutions in the embodiments of the present invention will be clearly and fully described below in combination with the drawings in the embodiments of the present invention. Apparently, the described embodiments are merely part of the embodiments of the present invention, not all of the embodiments. Based on the embodiments in the present invention, all other embodiments obtained by those ordinary skilled in the art without contributing creative labor will belong to the protection scope of the present invention.

By referring to FIGS. 1-7, the present invention provides the following technical solution: an inner buffer layer of a riding helmet comprises an inner buffer layer 1; the inner buffer layer 1 comprises a skeleton body 11 made of foam buffer materials; buffer bodies 2 made of foam buffer materials are embedded in hollow grooves of the skeleton body 11; and the surfaces of the buffer bodies 2 are provided with buffer layers 21;

The buffer layers 21 are a plurality of buffer bulges 22 fixedly connected to the surfaces of the buffer bodies 2.

Specifically, firstly, the skeleton body 11 of the inner buffer layer 1 is formed according to the size of the helmet body 3, and then the adapted buffer bodies 2 are processed according to the hollow groove structures of the skeleton body 11. In the forming process of the buffer bodies 2, a plurality of buffer bulges 22 are simultaneously processed, and the buffer bodies 2 are embedded in the hollow grooves, which can quickly complete the assembly of the skeleton body 11 and the buffer bodies 2 so that the inner buffer layer 1 with good buffer effect and capable of personalized customization is formed.

In the present embodiment: the inner buffer layer 1 and the buffer bodies 2 are made of EPS foamed plastic, polyethylene foamed plastic or polyurethane foam material.

Specifically, through the selection of the EPS foamed plastic, the polyethylene foamed plastic or the polyurethane foam material for processing the inner buffer layer 1 and buffer body 2, while ensuring that the inner buffer layer 1 and the buffer bodies 2 have good buffering, different materials can be flexibly selected for processing according to the processing needs of the inner buffer layer 1.

In the present embodiment: the hollow groove of the skeleton body 11 is one or more of a honeycomb groove 111, a round groove or a polygonal groove, and the buffer body 2 is one or more of a hexagonal buffer body 201, a cylindrical buffer body 202 or a polygonal buffer body 203.

Figure 2:
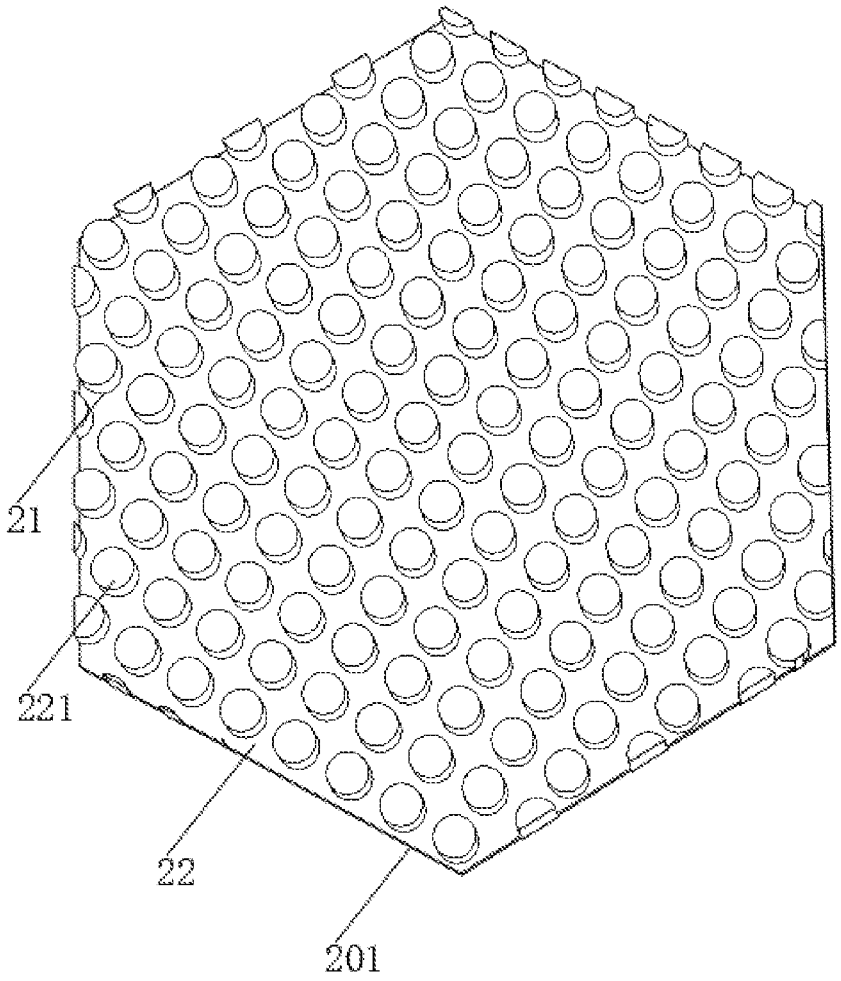
FIG. 2 is a structural schematic diagram of a hexagonal buffer body of the present invention.

Specifically, as shown in FIG. 1, the hollow grooves are honeycomb grooves 111; the skeleton body 11 of the honeycomb grooves 111 is selected to realize good beauty while ensuring the structural strength of the skeleton body 11; and then, the hexagonal buffer bodies 201 are selected. As shown in FIG. 2, a plurality of hexagonal buffer bodies 201 are embedded in the honeycomb grooves 111 to complete the assembly of the inner buffer layer 1.

Figure 3:
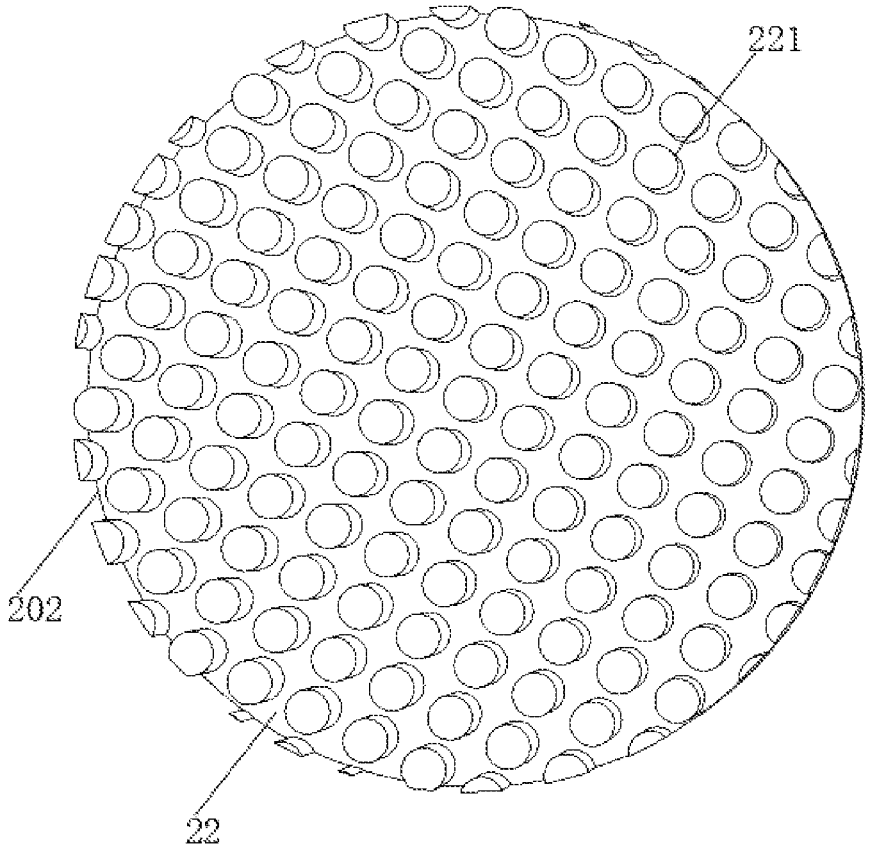
FIG. 3 is a structural schematic diagram of a cylindrical buffer body of the present invention.

When the hollow grooves are round grooves, cylindrical buffer bodies 202 can be selected, as shown in FIG. 3; and a plurality of cylindrical buffer bodies 202 are embedded in the corresponding round grooves, which can also complete the assembly of the inner buffer layer 1.

Figure 4:
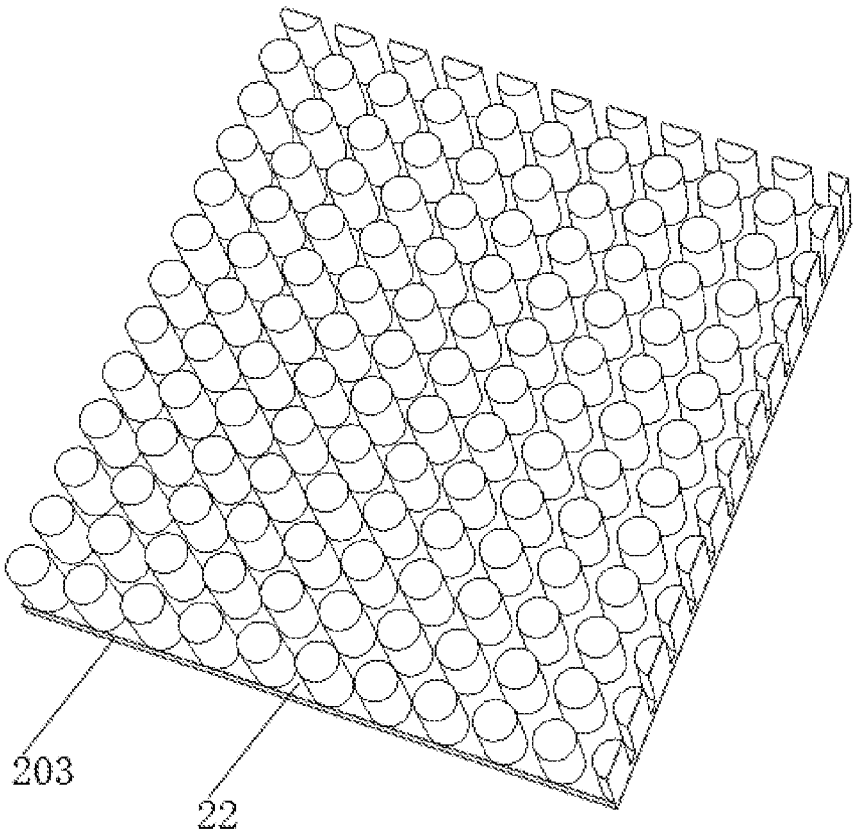
FIG. 4 is a structural schematic diagram of a polygonal buffer body of the present invention.

When the hollow grooves are polygonal grooves, polygonal buffer bodies 203 can be selected, as shown in FIG. 4; and a plurality of polygonal buffer bodies 203 are embedded in the corresponding polygonal grooves, which can also complete the assembly of the inner buffer layer 1.

In the inner buffer layer 1 of the above various structures, the inner buffer layer 1 can be flexibly selected according to the use demand of patients, which increases the universality of the inner buffer layer. The buffer bodies 2 of different forms can make the inner buffer layer 1 more personalized, and enable the inner buffer layer I to be customized by customers on the premise of ensuring good safety of the inner buffer layer 1.

In the present embodiment: the buffer bulge 22 is one or more of a cylindrical bulge 221, a triangular bulge or a polygonal bulge 222.

Figure 5:
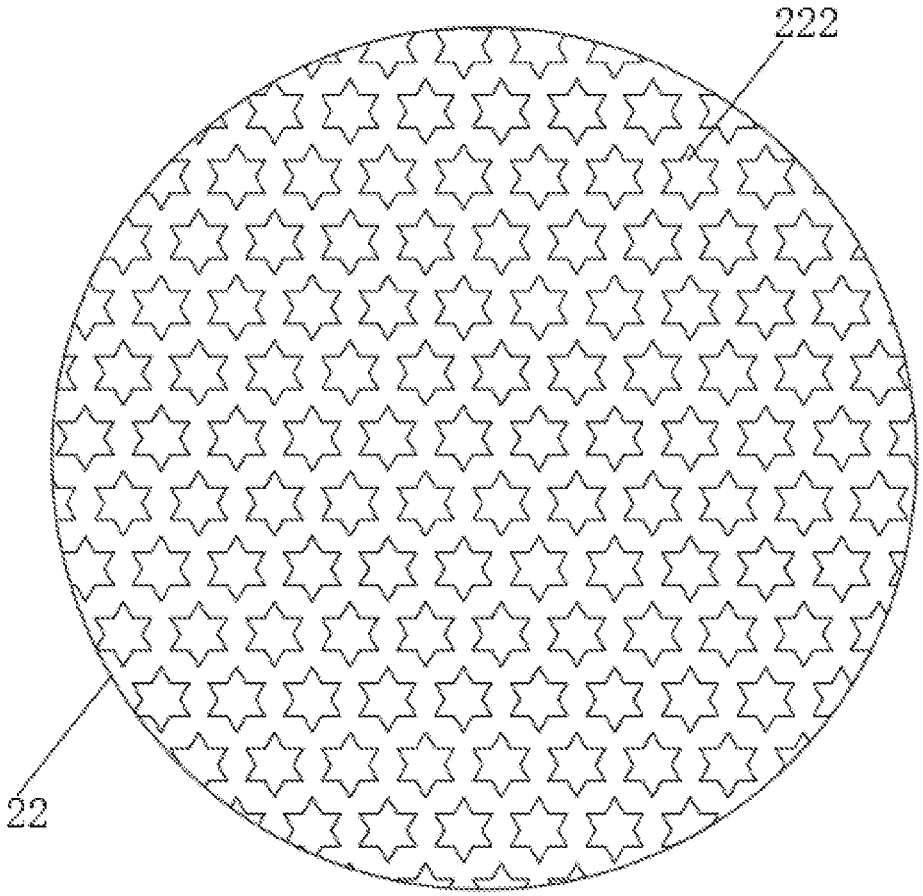
FIG. 5 is a structural schematic diagram of polygonal bulges of the present invention.
Figure 6:
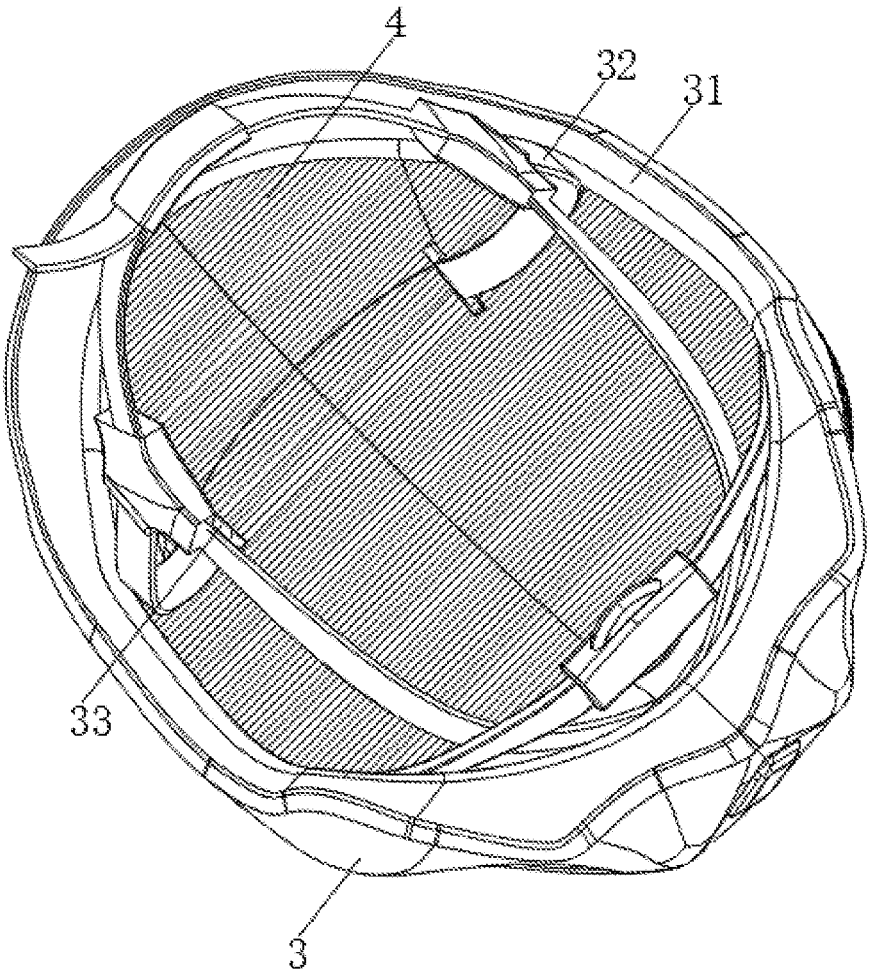
FIG. 6 is a structural schematic diagram of a helmet of the present invention.
Figure 7:
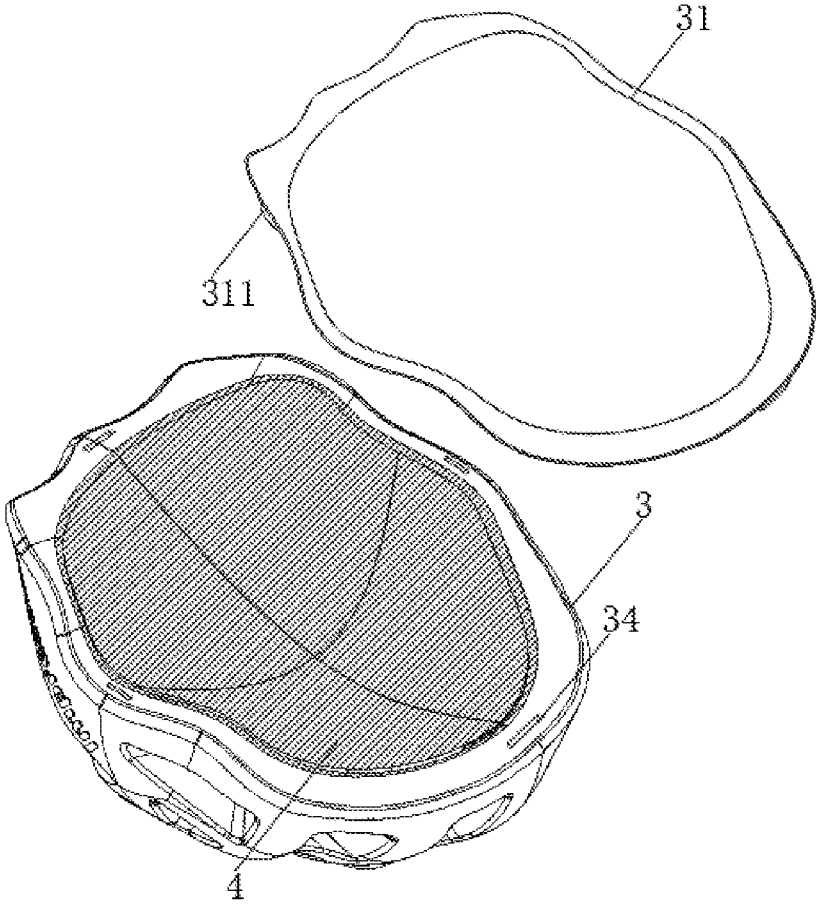
FIG. 7 is a structural schematic diagram of a pressing ring of the present invention.

Specifically, when the buffer bulges 22 are cylindrical bulges 221, as shown in FIG. 2, the buffer bulges 22 can be processed conveniently and quickly while the cylindrical bulges 221 can increase the buffering performance and buffer stroke of the buffer bodies 2, so as to further increase the buffer effect of the inner buffer layer 1. Moreover, the plurality of cylindrical bulges 221 installed can effectively increase the frictional force in the wearing process of the helmet, and effectively prevent the helmet from falling off the head of the wearer at the moment of accident impact. The buffer bulges 22 can also be customized according to user preferences, and can also be processed into triangular bulges or polygonal bulges 222 (as shown in FIG. 5). Of course, the buffer bulges 22 on one buffer body 2 can also be arranged in the combination form of cylindrical bulges 221, triangular bulges or polygonal bulges 222, and the buffer bulges 22 of different structures can also make the buffer body 2 have customized buffering performance.

In the present embodiment: the plurality of buffer bulges 22 are arranged at equal distance or non-equal distance on the surfaces of the buffer bodies 2, and one end of the plurality of buffer bulges 22 is equidistant from the head of a wearer.

Specifically, the distance arrangement of the adjacent buffer bulges 22 is controlled, which can also realize the buffer customization of the buffer bodies 2. By controlling the distance between the buffer bulges 22 and the head of the wearer, not only good buffering performance of the buffer bulges 22 can be ensured, but also the comfort of the helmet during wearing is ensured.

A helmet structure comprises the inner buffer layer of the riding helmet in any one of the above, and further comprises a helmet body 3; a skeleton body 11 is bonded in the helmet body 3; a plurality of buffer bodies 2 are arranged in hollow grooves of the skeleton body 11; a fabric inner cushion body 4 is also arranged at the inner side of each buffer body 2; and the edge of the fabric inner cushion body 4 is pressed and fixed by a pressing ring 31 arranged on the edge of the helmet body 3.

Specifically, the inner side of the skeleton body 11 is pasted with a velcro loop, and the inner side of the helmet body 3 is pasted with a velcro hook with adapted size. The velcro loop is bonded with the velcro hook to quickly disassemble and assemble the skeleton body 11, and the installed fabric inner cushion body 4 is in contact with the head of the user, which can increase the comfort of helmet wearing. The edge of the fabric inner cushion body 4 is pressed and fixed by the pressing ring 31 and the helmet body 3, which is convenient for the user to disassemble, assemble and clean the fabric inner cushion body 4, and also convenient for the user to replace the inner buffer layer 1 and the buffer bodies 2.

In the present embodiment: both sides of the bottom of the helmet body 3 are fixedly connected with helmet belts 32, and one end of the two helmet belts 32 is fixedly connected through a belt buckle 33.

Specifically, the installed helmet belts 32 are matched with the belt buckle 33, which can increase the fastness of the helmet worn by the user and effectively prevent the helmet from slipping off the head of the user.

In the present embodiment: the bottom of the pressing ring 31 is fixedly connected with a plurality of wedge pins 311, and the pressing ring 31 is fitted with the bottom of the helmet body 3 and then clamped and connected with a clamping groove 34 arranged at the bottom of the helmet body 3.

Specifically, the installed wedge pins 311 are clamped and connected with the clamping groove 34, which is convenient for the user to disassemble and assemble the pressing ring 31 and the helmet body 3.

In the present embodiment: the size of the inner buffer layer 1 is adapted with the size of the helmet body 3, and the size of the fabric inner cushion body 4 is adapted with the size of the inner buffer layer 1.

Specifically, through the specific size control of the inner buffer layer 1 and the fabric inner cushion body 4, the fabric inner cushion body 4 can be closely fitted to the inner side of the inner buffer layer 1, while the inner buffer layer 1 is closely fitted to the inner side of the helmet body 3, to effectively ensure the comfort of the user when wearing the helmet.

Working principle: According to the size of the helmet, an appropriate inner buffer layer 1 is selected to ensure that its adaptation with the size of the helmet body 3. The skeleton body 11 is bonded into the helmet 3, and the velcro loop is bonded with the velcro hook to quickly disassemble and assemble the skeleton body 11. According to the hollow groove structure of the skeleton body 11, the adapted buffer body 2 is selected for embedment to ensure that the assembly of the buffer body 2 and the skeleton body 11 is intact. The plurality of buffer bulges 22 on the surface of the buffer body 2 are arranged at equal distance or non-equal distance on the surfaces of the buffer bodies 2, which can ensure the buffering performance of the buffer body 2. Then, the edge of the fabric inner cushion body 4 is pressed and fixed by the pressing ring 31 arranged on the edge of the helmet body 3. The fabric inner cushion body 4 is in contact with the head of the user, which can increase the comfort of helmet wearing. In the process of use, the buffer effect of the skeleton body 11 and the buffer body 2 of the inner buffer layer 1 will play a role in protecting the head, while the personalized customization and the comfort of the inner buffer layer 1 increase the use experience of the wearer.

Finally, it should be noted that the above description is only a preferred embodiment of the present invention, and is not intended to limit the present invention. Although the present invention is described in detail with reference to the above embodiment, those skilled in the art may still modify the technical solution recorded in the above embodiment, or equivalently replace some of the technical features. Any modification, equivalent replacement, improvement, etc. made within the spirit and the principle of the present invention shall be included within the protection scope of the present invention.

The invention claimed is:

1. A helmet structure, comprising an inner buffer layer and a helmet body (3), wherein the inner buffer layer (1) comprises a skeleton body (11) made of foam buffer materials; buffer bodies (2) made of foam buffer materials are embedded in hollow grooves of the skeleton body (11); and surfaces of the buffer bodies (2) are provided with buffer layers (21);

the buffer layers (21) are a plurality of buffer bulges (22) fixedly connected to the surfaces of the buffer bodies (2); and the skeleton body (11) is bonded in the helmet body (3); a fabric inner cushion body (4) is arranged at an inner side of each buffer body (2); and an edge of the fabric inner cushion body (4) is pressed and fixed by a pressing ring (31) arranged on an edge of the helmet body (3).

2. The helmet structure according to claim 1, wherein both sides of a bottom of the helmet body (3) are fixedly connected with helmet belts (32), and one end of the helmet belts (32) is fixedly connected through a belt buckle (33).

3. The helmet structure according to claim 1, wherein a bottom of the pressing ring (31) is fixedly connected with a plurality of wedge pins (311), and the pressing ring (31) is fitted with a bottom of the helmet body (3) and then clamped and connected with a clamping groove (34) arranged at the bottom of the helmet body (3).

4. The helmet structure according to claim 1, wherein a size of the inner buffer layer (1) is adapted with a size of the helmet body (3), and a size of the fabric inner cushion body (4) is adapted with the size of the inner buffer layer (1).

* * * * *